US007696677B2

(12) United States Patent
Ito et al.

(10) Patent No.: US 7,696,677 B2
(45) Date of Patent: Apr. 13, 2010

(54) LAMINATION-TYPE RESISTANCE ELEMENT

(75) Inventors: Yasunori Ito, Kaka (JP); Kiyohiro Koto, Higashiomi (JP); Masahiko Kawase, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 767 days.

(21) Appl. No.: 10/595,232

(22) PCT Filed: Oct. 28, 2004

(86) PCT No.: PCT/JP2004/016044

§ 371 (c)(1),
(2), (4) Date: Mar. 28, 2006

(87) PCT Pub. No.: WO2005/043556

PCT Pub. Date: May 12, 2005

(65) Prior Publication Data

US 2006/0279172 A1 Dec. 14, 2006

(30) Foreign Application Priority Data

Oct. 31, 2003 (JP) ..... 2003-372846

(51) Int. Cl.
*H01C 7/04* (2006.01)
*H01C 7/10* (2006.01)

(52) U.S. Cl. ..... 310/365; 338/22 R; 338/328; 338/332; 310/328

(58) Field of Classification Search ..... 310/363–366; 361/311, 305, 303, 321; 338/22 R, 307, 338/328, 332, 313
See application file for complete search history.

(56) References Cited

U.S. PATENT DOCUMENTS 5,075,665 A * 12/1991 Taira et al. ..... 338/21
6,008,717 A * 12/1999 Kawase et al. ..... 338/22 R
6,078,250 A * 6/2000 Ueda et al. ..... 338/313
6,147,587 A * 11/2000 Hadano et al. ..... 338/21
6,163,246 A * 12/2000 Ueda et al. ..... 338/331

(Continued)

FOREIGN PATENT DOCUMENTS

JP 01066903 A * 3/1989
JP 2-260605 A 10/1990
JP 05-243007 9/1993
JP 06-034201 2/1994
JP 10-247601 9/1998

(Continued)

OTHER PUBLICATIONS

International Search Report for PCT Application No. PCT/JP2004/016044, mailed Feb. 15, 2005.

(Continued)

*Primary Examiner*—Jaydi SanMartin
(74) *Attorney, Agent, or Firm*—Keating & Bennett, LLP

(57) ABSTRACT

A lamination-type resistance element includes a laminated sinter having internal electrodes of a first group and internal electrodes of a second group, the first internal electrode group including a plurality of internal electrodes facing each other through a ceramic resistance layer and defining a resistance unit at the portion where the plurality of internal electrodes face each other. A first end of the resistance unit is connected to a first external electrode and the second end is connected to a second external electrode. The second internal electrode group includes a plurality of pairs of internal electrodes in which the inner ends face each other through a gap on the same plane inside the laminated sinter, and a plurality of pairs of gaps in the plurality of internal electrodes are arranged at the same location when seen from one end of the lamination direction of the laminated sinter. Thereby, fine adjustment of a resistance value can be performed.

10 Claims, 3 Drawing Sheets

U.S. PATENT DOCUMENTS

| | | | | |
|---|---|---|---|---|
| 6,236,302 | B1 * | 5/2001 | Barrett et al. | 338/22 R |
| 6,242,997 | B1 * | 6/2001 | Barrett et al. | 338/22 R |
| 6,525,395 | B1 * | 2/2003 | Kawase et al. | 257/528 |
| 6,593,844 | B1 * | 7/2003 | Iwao et al. | 338/22 R |
| 6,717,506 | B2 | 4/2004 | Ishii | |
| 7,003,858 | B2 * | 2/2006 | Sube et al. | 29/25.35 |
| 7,075,408 | B2 * | 7/2006 | Mihara et al. | 338/22 R |
| 7,135,955 | B2 * | 11/2006 | Feichtinger et al. | 338/22 R |
| 2002/0089409 | A1 | 7/2002 | Ishii | |

FOREIGN PATENT DOCUMENTS

| | | | | |
|---|---|---|---|---|
| JP | 10247601 | A | * | 9/1998 |
| JP | 10270207 | A | * | 10/1998 |
| JP | 11-111554 | A | | 4/1999 |
| JP | 2000-124008 | | | 4/2000 |
| JP | 2001-35707 | A | | 2/2001 |
| JP | 2001237107 | A | * | 8/2001 |
| JP | 2001338805 | A | * | 12/2001 |
| JP | 2002-252103 | A | | 9/2002 |
| JP | 2005340589 | A | * | 12/2005 |

OTHER PUBLICATIONS

Official communication issued in the counterpart Korean Application No. 10-2006-7008237, mailed on Jun. 13, 2007.

Official communication issued in counterpart Japanese Application No. 2005-515155, mailed on Dec. 2, 2008.

Official communication issued in counterpart European Application No. 04793152.2, mailed on Apr. 2, 2009.

Official communication issued in counterpart Chinese Application No. 200480032064.4, mailed on Apr. 3, 2009.

* cited by examiner

LAMINATION-TYPE RESISTANCE ELEMENT

BACKGROUND OF THE INVENTION

1. Field of the Invention

The present invention relates to a lamination-type resistance element and more particularly to a lamination-type resistance element in which internal electrodes are disposed inside a laminated sinter so as to enable fine adjustment of a resistance value.

2. Description of the Related Art

To date, resistance elements such as PTC thermistors and NTC thermistors have been used for temperature compensation and temperature detection. Among such resistance elements, there is a lamination-type resistance element that can be mounted on a printed circuit board, etc. Hereinafter, examples of related lamination-type resistance elements are described.

FIG. 7 is a sectional view showing a first related example wherein the resistance element is an NTC thermistor.

In a lamination-type thermistor 1 shown in FIG. 7, first internal electrodes 4*a* and 4*b* and second internal electrodes 5*a* and 5*b* are provided inside a laminated sinter 3 in which a plurality of thermistor layers 2 are integrally sintered. External electrodes 7 and 8 are provided on the outer surface and more specifically on both end portions of the laminated sinter 3.

One end portion of the first internal electrode 4*a* and one end portion of the second internal electrode 5*a* face each other on the same planar surface with a gap 6*a* therebetween. The other end portion of the first internal electrode 4*a* is electrically connected to the external electrode 7 and the other end portion of the second internal electrode 4*b* is electrically connected to the external electrode 8.

Furthermore, one end portion of the first internal electrode 4*b* and one end portion of the second internal electrode 5*b* face each other on the same planar surface with a gap 6*b* therebetween. The other end portion of the first internal electrode 4*b* is electrically connected to the external electrode 7 and the other end portion of the second internal electrode 5*b* is electrically connected to the external electrode 8.

The gaps 6*a* and the gaps 6*b* are alternately disposed along the lamination direction of the plurality of thermistor layers 2 inside the laminated sinter 3. Furthermore, the gaps 6*a* and the gaps 6*b* are arranged at different locations in the direction that is substantially perpendicular to the lamination direction of the laminated sinter 3.

FIG. 8 is a sectional view showing a second related example and, in the same way as in FIG. 7, the resistance element is an NTC thermistor.

In a lamination-type NTC thermistor 11 shown in FIG. 8, first internal electrodes 14*a* and second internal electrodes 14*b* are provided inside a laminated sinter 13 in which a plurality of thermistor layers 12 are integrally sintered. Furthermore, internal electrodes 16 are arranged so as to face the first internal electrodes 14*a* and second internal electrodes 14*b* through a thermistor layer 12. External electrodes 17 and 18 are provided on the outer surface of the laminated sinter 12 and more specifically on both end portions.

One end portion of the first internal electrode 14*a* and one end portion of the second internal electrode 14*b* are arranged so as to face each other on the same plane with a gap 15 therebetween. The other end portion of the first internal electrode 14*a* is electrically connected to the external electrode 17 and the other end portion of the second internal electrode 14*b* is electrically connected to the external electrode 18.

The internal electrode 16 is a no-connection-type internal electrode, both end portions of which are not extended out to the outer surface of the laminated sinter 13 and which are not connected to the external electrodes 17 and 18.

The resistance value of the first related lamination-type resistance element is determined by the size of the gap 6*a* between the first internal electrode 4*a* and the second internal electrode 5*a*, the size of the gap 6*b* between the first internal electrode 4*b* and the second internal electrode 5*b*, and the overlapping area between the first internal electrode 4*a* and the second internal electrode 5*b* and the space therebetween.

Furthermore, the resistance value of the second related lamination-type resistance element is determined by the size of the gap 15 between the first internal electrode 14*a* and the second internal electrode 14*b*, the overlapping area between the first internal electrode 14*a* and the no-connection-type internal electrode 16 and the space therebetween, and the overlapping area between the second internal electrode 14*b* and the no-connection-type internal electrode 16 and the space therebetween.

In Japanese Unexamined Patent Application Publication No. 2000-124008, a third related lamination-type resistance element is disclosed. In a resistance element disclosed in Japanese Unexamined Patent Application Publication No. 2000-124008, inside a negative characteristic thermistor element, first and second internal electrodes are disposed so as to lie on top of one another with a thermistor element layer therebetween, the internal electrode is extended out to one end of the negative characteristic thermistor element, and the other internal electrode is extended out to the other end. Then, the first and second external electrodes are arranged at both ends of the thermistor element. Furthermore, a resistor layer made of a resistive material that is different from the material defining the thermistor element is laminated on the thermistor element. Then, a pair of internal electrodes, one end of each facing one end of the other with a gap therebetween on the same plane, are provided inside of the resistor layer. One of the internal electrodes is electrically connected to the first external electrode and the other is electrically connected to the second external electrode.

Here, the resistance value can be set by adjustment of not only material characteristics and the shape of the above-described resistor layer, but also the pattern of a pair of electrodes inside the resonator layer, and thus, the freedom of setting the resistance value can be increased.

Furthermore, in Japanese Unexamined Utility Model Registration Application Publication No. 6-34201, an NTC thermistor as a lamination-type resistance element according to a fourth example is disclosed. That is, an NTC thermistor in which a plurality of pairs of internal electrodes, the inner end of one of the pair facing the inner end of the other with a gap therebetween on the same plane, are provided inside a lamination-type resistor. Here, in each pair of internal electrodes, one internal electrode is electrically connected to a first external electrode provided on one end surface of the resistor and the other internal electrode is electrically connected to a second external electrode provided on the other end surface of the resistor. Then, when seen from a direction perpendicular to the upper surface of the resistor, in each of the plurality of pairs, the one internal electrode and the other internal electrode are disposed so as not to lie on top of one another. In this NTC thermistor, since the resistance value is determined by the size of a gap between a pair of internal electrodes disposed on the same plane, it is possible to reduce variations of the resistance value.

When the resistance value is adjusted in the first and second lamination-type resistance elements, the number of laminations of each internal electrode is increased or reduced. However, in the case of adjustment of the resistance value, in the first related example, since the number of internal electrodes 4*a*, 4*b*, 5*a*, and 5*b* facing each other through a thermistor layer 2 is increased or reduced, the range of change of the resistance value is wide and fine adjustment of the resistance value is difficult. In the second related example, the number of units made of internal electrodes 14*a* and 14*b* and internal electrodes 16 facing each other through a thermistor 12 is increased or decreased. Accordingly, the range of change of the resistance value is also wide and fine adjustment of the resistance value is difficult.

On the other hand, in the lamination-type resistance element of the third related example, since the resistor layer is made using a material different from a negative characteristic thermistor element, the manufacturing process becomes complicated and, as a matter of course, the cost increases. Furthermore, since the thickness of the resistor layer is required to be sufficiently smaller than the thickness of the thermistor element, the design of the resistor and the internal electrodes are naturally restricted. Therefore, reduction in the resistance and fine adjustment of the resistance value are difficult.

Furthermore, in an NTC thermistor described in the above-described Japanese Unexamined Utility Model Registration Application Publication No. 6-34201, reduction in the resistance is limited although variations of the resistance value can be reduced. When the size of the gap is reduced for each pair of internal electrodes disposed with a gap therebetween on the same plane, it is possible to decrease the resistance value. However, when the gap is reduced, since a short circuit becomes likely to occur, reduction in the resistance is limited.

SUMMARY OF THE INVENTION

In order to overcome the problems described above, preferred embodiments of the present invention provide a lamination-type resistance element having a structure in which fine adjustment of the resistance value can be made in the lamination-type resistance element using a laminated sinter having internal electrodes.

According to a preferred embodiment of the present invention, it is possible to provide a lamination-type resistance element including a laminated sinter having a plurality of ceramic resistance layers and a plurality of internal electrodes laminated therein, and a first external electrode and a second external electrode arranged on the outer surface of the laminated sinter. In the lamination-type resistance element, the plurality of internal electrodes includes a plurality of internal electrodes of a first group and a plurality of internal electrodes of a second group, the plurality of internal electrodes of the first group including a resistance unit in which at least two internal electrodes are disposed so as to face each other through the ceramic resistance layer, one end of the resistance unit being electrically connected to the first external electrode, and the other end being electrically connected to the second external electrode. The internal electrodes of the second group include a plurality of pairs of internal electrodes, one end of each facing one end of the other with a gap therebetween on the same plane inside the laminated sinter, one internal electrode in each pair being electrically connected to the first external electrode, and the other being electrically connected to the second external electrode.

In a specific preferred embodiment of a lamination-type resistance element according to the present preferred embodiment, the plurality of gaps of the second group is arranged so as to lie on top of one another in the lamination direction in the laminated sinter.

In another specific preferred embodiment of a lamination-type resistance element according to the present invention, each of the internal electrodes of the first group includes a first divided internal electrode electrically connected to the first external electrode and a second divided internal electrode electrically connected to the second external electrode and one end of the first divided internal electrode and one end of the second divided internal electrode face each other with a gap therebetween on the same plane. Regarding the internal electrodes of each pair of the second internal electrode group, when the internal electrode electrically connected to the first external electrode is made a third internal electrode and the other internal electrode electrically connected to the second external electrode is made a fourth internal electrode, the topmost gap of the first group is aligned with the bottommost gap of the second group.

The structure of the above-described internal electrodes of the first group can be variously modified in the present invention.

That is, in another specific preferred embodiment of the present invention, a plurality of pairs of first and second divided internal electrodes are laminated and the gaps between adjacent pairs of electrodes in the lamination direction are provided at different locations when seen from one side in the lamination direction.

Furthermore, in another specific preferred embodiment of a lamination-type resistance element according to the present invention, in the internal electrodes of the first group, a no-connection-type internal electrode disposed on top of the first and second divided internal electrodes through a ceramic resistance layer is further provided.

In another specific preferred embodiment of a lamination-type resistance element according to the present invention, the internal electrodes of a first group includes the first internal electrode electrically connected to the first external electrode and a second internal electrode electrically connected to the second external electrode, and the first and second internal electrodes are disposed so as to lie on top of one another through a ceramic layer disposed therebetween.

The above-described three lamination-type resistance elements in which the structures of the first internal electrodes are different from each other can be described as the following first to third preferred embodiments.

A lamination-type resistance element as a first preferred embodiment of the present invention includes a laminated sinter having a plurality of ceramic resistance layers and a plurality of internal electrodes laminated therein, and a first external electrode and a second external electrode provided on the outer surface of the laminated sinter. In the lamination-type resistance element, the internal electrodes include internal electrodes of a first group and internal electrodes of a second group, wherein the internal electrodes of a first group each include a first internal electrode and a second internal electrode, one end of each being arranged so as to face one end of the other with a gap therebetween on the same plane inside the laminated sinter and the other ends being connected to the first external electrode and the second external electrode, respectively, and neighboring gaps between the first and second internal electrodes in the lamination direction of the laminated sinter are arranged at different locations when seen from the lamination direction of the laminated sinter. The internal electrodes of the second group include third internal electrodes and fourth internal electrodes, one end of each facing one end of the other with a gap therebetween on the same plane inside the laminated sinter and the other ends being connected to the first external electrode and the second external electrode, respectively, and the gaps between the third internal electrodes and fourth internal electrodes are at the same location along the lamination direction of the laminated sinter.

Furthermore, a second preferred embodiment for solving the problems described above is a lamination-type resistance element including a laminated sinter having a plurality of ceramic resistance layers and a plurality of internal electrodes laminated therein, and a first external electrode and a second external electrode provided on the outer surface of the laminated sinter. In the lamination-type resistance element, the internal electrodes include internal electrodes of a first group and internal electrodes of a second group, wherein the internal electrodes of the first group each include a first internal electrode and a second internal electrode one end of each being arranged so as to face one end of the other with a gap therebetween on the same plane inside the laminated sinter and the other ends being connected to the first external electrode and the second external electrode, respectively, and a no-connection-type internal electrode which is arranged so as to lie on top of the first internal electrode and the second internal electrode through the ceramic resistance layer in the lamination direction of the laminated sinter and which is not connected to the first and second external electrodes. The internal electrodes of the second group each includes a third internal electrode and a fourth internal electrode, one end of each facing one end of the other with a gap therebetween on the same plane inside the laminated sinter and the other ends being connected to the first external electrode and the second external electrode, respectively, and the gaps between the third internal electrodes and fourth internal electrodes are at the same location along the lamination direction of the laminated sinter.

A third preferred embodiment is a lamination-type resistance element including a laminated sinter having a plurality of ceramic resistance layers and a plurality of internal electrodes laminated therein, and a first external electrode and a second external electrode provided on the outer surface of the laminated sinter. In the lamination-type resistance element, the internal electrodes include internal electrodes of a first group and internal electrodes of a second group, the internal electrodes of the first group each includes a first internal electrode connected to the first external electrode and a second internal electrode connected to the second external electrode which face each other through the ceramic resistance layer. The internal electrodes of the second group each includes a third internal electrode and a fourth internal electrode, one end of each facing one end of the other with a gap therebetween on the same plane inside the laminated sinter and the other ends being connected to the first external electrode and the second external electrode, respectively, and the gaps between the third internal electrodes and fourth internal electrodes are at the same location along the lamination direction of the laminate sinter.

In a lamination-type resistance element of the preferred embodiments of the present invention, fine adjustment of the resistance value can be made by providing internal electrodes of a second group inside a laminated sinter. That is, in a plurality of pairs of internal electrodes defining the internal electrodes of the second group, the internal electrodes of each pair are disposed with a gap therebetween on the same plane inside the laminated sinter. Since the resistance value determined by the gap is small, fine adjustment of the resistance value of the lamination-type resistance element can be made by changing the size of the gap in the plurality of pairs of internal electrodes and the number of pairs in the plurality of pairs of electrodes. That is, fine adjustment of the resistance value can be made by adjustment of the portion where the internal electrodes of the second group are located without greatly affecting the resistance value to be determined by the portion where the internal electrodes of the first group are located.

Furthermore, since it is possible to design a laminated sinter, that is, to design and set the resistance value in the same process as the technology for laminating ceramic resistance layers and internal electrodes, fine adjustment of the resistance value can be easily made.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
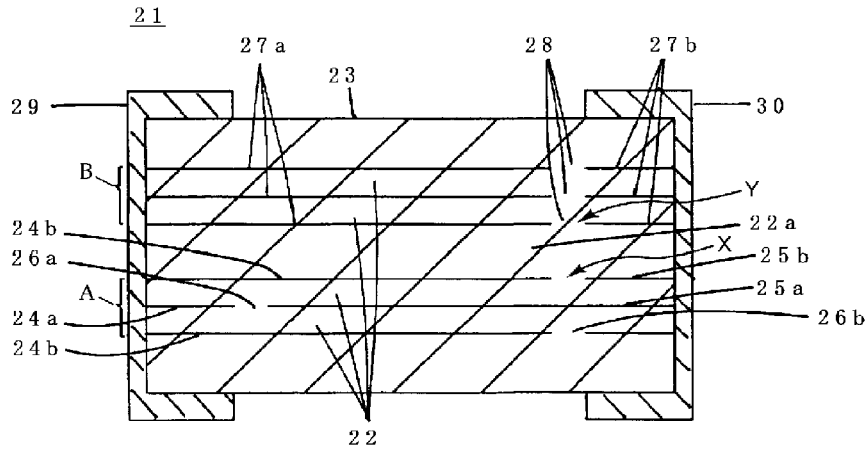
FIG. 1 is a sectional view showing a first preferred embodiment of a lamination-type resistance element of the present invention.

FIG. 1 is a sectional view of a first preferred embodiment of a lamination-type resistance element.

A lamination-type resistance element 21 shown in FIG. 1 includes a laminated sinter 23 in which a plurality of NTC thermistor layers 22 as a plurality of ceramic resistance layers is laminated and integrally sintered. First internal electrodes 24*a* and 24*b* and second internal electrodes 25*a* and 25*b* are provided inside the laminated sinter 23. External electrodes 29 and 30 are provided on the outer surface, specifically, on both end portions of the laminated sinter 23.

The first internal electrode 24*a* as a first divided internal electrode and the internal electrode 25*a* as a second divided internal electrode are arranged in such a way that one end portion of the internal electrode 24*a* and one end portion of the internal electrode 25*a* face each other on the same planar surface with a gap 26*a* therebetween. The other end portion of the first internal electrode 24*a* is electrically connected to the external electrode 29 and the other end portion of the second internal electrode 25*a* is electrically connected to the external electrode 30.

Moreover, when internal electrodes on the same plane are seen as a unified electrode, the divided internal electrodes indicate one electrode separated by a gap. For example, the internal electrode 24*a* and the internal electrode 25*a* are considered as a unified electrode on the same plane and each of the ones separated by a gap may be called a divided internal electrode 24*a* and a divided internal electrode 25*a*, respectively. Furthermore, when the internal electrode 25*a* and an internal electrode 24*b*, for example, lie on top of one another through a thermistor layer, the internal electrode 25*a* may be simply called an internal electrode.

Furthermore, the first internal electrode 24*b* as a divided internal electrode and the second internal electrode 25*b* are arranged in such a way that one end portion of the internal electrode 24*b* and one end portion of the internal electrode 25*b* face each other on the same plane with a gap 26*b* therebetween. The other end portion of the first internal electrode 24*b* is electrically connected to the external electrode 29 and the other end portion of the second internal electrode 25*b* is electrically connected to the external electrode 30.

The gaps 26*a* and 26*b* are disposed inside the sinter 23 so as to be next to each other along the lamination direction of the plurality of thermistors 22. Furthermore, the gaps 26*a* and 26*b* are arranged so as to be at different locations in the direction perpendicular to the lamination direction of the sinter 23 and in the direction in which both end portions of the sinter 23 are connected. The above-described structure of the first internal electrodes 24*a* and 24*b* corresponds to a first internal electrode group A of the present invention. Here, a resistance unit is defined by the two internal electrodes 24*b* and 24*b* each put on top of the internal electrode 25*a* with a thermistor layer as a ceramic resistance layer therebetween. One end of the resistance unit is connected to the first external electrode 29 and the other end is connected to the second external electrode 30. Moreover, in the present preferred embodiment, the internal electrodes 24*b* and 24*b* and the internal electrode 25*a*, that is, the three internal electrodes, are put on top of one another with thermistor layers disposed therebetween in the above-described resistance unit of the first internal electrode group A. But, in the present preferred embodiment, since it is sufficient to have at least two internal electrodes facing each other through a ceramic resistance layer, the number of laminations of internal electrodes facing each other through a ceramic resistance layer is not particularly limited.

The lamination-type thermistor 21 further includes the following structure. That is, a second internal electrode group B is provided above the first internal electrode group A inside the sinter 23.

The second internal electrode group B has the following structure. Third internal electrodes 27*a* and fourth internal electrodes 27*b* are provided inside the laminated sinter 23 in which the plurality of thermistor layers 22 are integrally sintered. The third internal electrodes 27*a* and the fourth internal electrodes 27*b* are arranged in such a way that one end portion of the internal electrode 27*a* and one end portion of the internal electrode 27*b* face each other on the same plane with a gap 28 therebetween. The other end portion of the third internal electrode 27*a* is electrically connected to the external electrode 29 and the other end portion of the fourth internal electrode 27*b* is electrically connected to the external electrode 30.

The gaps 28 of the second internal electrode group B are provided at the same location, when seen from one end side of the lamination direction of the plurality of thermistor layers 22, for example, from the upper inside of the laminated sinter 23. Furthermore, the gaps 28 are provided at a different location from the gap 26*a* of the first internal electrode group A when seen from one end side in the lamination direction of the thermistor layers, more specifically, at a different location in the direction connecting both end portions of the laminated sinter 23. Moreover, in the second internal electrode group B shown in FIG. 1, three sets of electrodes made up of third internal electrodes 27*a* and fourth internal electrodes 27*b* are put on top of one another, but the number of layers of the combination may be designed according to a target resistance value. Furthermore, in FIG. 1, the thickness of an NTC thermistor layer 22*a* existing between the first internal electrode group A and the second internal electrode group B is preferably larger than the thickness of the other NTC thermistor layers 22, but the thickness may also be made the same.

In the lamination-type resistance element according to the first preferred embodiment, the resistance value is determined in the following way. That is, in the first internal electrode group A, the resistance value is determined by the size of the gaps 26*a* and 26*b* between the first internal electrodes 24*a* and 25*a* and between the second internal electrodes 24*b* and 25*b*, respectively, and by the overlapping area and space between the first internal electrode 24*a* and the second internal electrode 25*b*. Moreover, in the second internal electrode group B, the resistance value is determined by the size of the gaps 28 between the third internal electrodes 27*a* and the fourth internal electrodes 27*b*. Accordingly, the resistance value of the lamination-type resistance element becomes a composite resistance value of the resistance values of the first internal electrode group A and the second internal electrode group B. In the second internal electrode group B, although the resistance value is determined by the size of the gap 28, the resistance value produced by the gap 28 is small.

Furthermore, in the first preferred embodiment, since three sets of internal electrodes 27*a* and internal electrodes 27*b* are laminated in the second internal electrode group B, the three gaps 28 are next to each other in the lamination direction of the thermistor layers 22 and disposed so as to lie on top of one another when seen from one end side in the lamination direction. That is, the gaps 28 and 28 face each other through one thermistor layer 22. In this way, since a plurality of gaps 28 is disposed in the second internal electrode group B and the plurality of gaps are disposed so as to lie on top of one another, not only is the resistance value created by the size of one gap 28 small, but the resistance value of the second internal electrode group B determined by the space between the plurality of gaps 28 is also small. Accordingly, it becomes possible to make fine adjustment of the resistance value of the whole lamination-type resistance element by means of the second internal electrode group.

Moreover, in the lamination-type thermistor 21 of the first preferred embodiment, not only can fine adjustment of the resistance value be made in the above-described way, but also there is an advantage in that fine adjustment of the resistance value can be made more precisely. That is, in the lamination-type thermistor 21 of the first preferred embodiment, the gap 26*b* between a first internal electrode 24*b* and a second internal electrode 25*b* of the first internal electrode group and the gap 28 between a third internal electrode 27*a* and a fourth internal electrode 27*b* of the second internal electrode group are disposed so as to be at the same location, that is, to lie on top of one another when seen from the lamination direction, the gap 26*b* and the gap 28 being next to each other through the thermistor layer 22*a*. In order to show this more clearly, in FIG. 1, reference characters X and Y are given to the gaps which can be made close to each other at the same location when seen from the above-described lamination direction.

As is clear in FIG. 1, the gap X closest to the second internal electrode group of the gaps 26*b* of the first internal electrode group, and the gap Y closest to the first internal electrode group of the gaps 28 of the second internal electrode group, are arranged at the same location when seen from the lamination direction.

This means that the first internal electrode 24*b* and the second internal electrode 25*b* for defining the gap X can be made in the same shape as the third internal electrode 27*a* and the fourth internal electrode 27*b* for defining the gap Y. In the present preferred embodiment, since the internal electrode pattern on the upper surface of the thermistor layers 22 is the same as the internal electrode pattern on the lower surface and the gaps X and Y are at the same location when seen from one end side in the lamination direction, fine adjustment of the resistance value can be made more precisely. This is because the inner ends of the internal electrodes 24*b* and 25*b* defining the gap X in the first internal electrode group and the inner ends of the third and fourth internal electrodes 27*a* and 27*b* defining the gap Y in the second internal electrode group are uniform in location and accordingly the current path becomes uniform and variations of the resistance value can be more reduced.

Accordingly, when the first internal electrode group and the second internal electrode group are disposed in parallel in the lamination direction and the above-described gaps are provided in the internal electrodes close to each other in the first internal electrode group and the second internal electrode group, it is desirable to dispose the gaps at the same location when seen from the lamination direction, that is, to dispose the gaps so as to lie on top of one another.

However, in the present preferred embodiment, it is not necessarily required to put the second internal electrode group above or below the first internal electrode group in parallel, and the first internal electrode group may be disposed in the portion where the second internal electrode group is provided.

Figure 2:
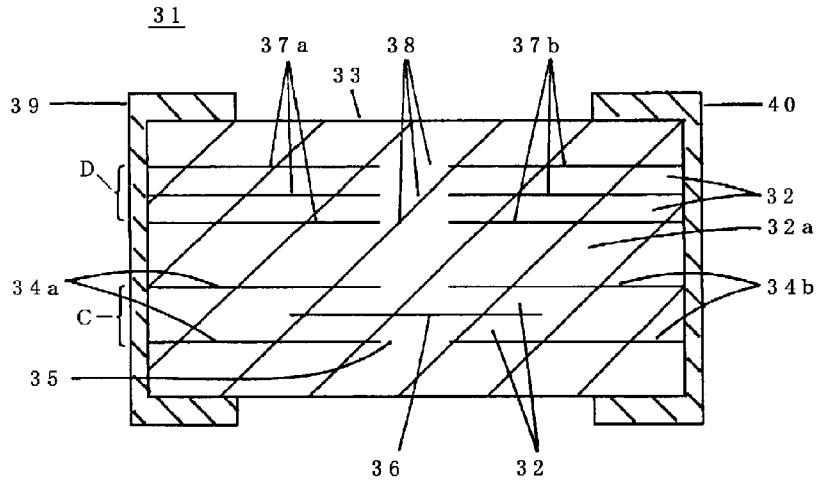
FIG. 2 is a sectional view showing a second preferred embodiment of a lamination-type resistance element of the present invention.

FIG. 2 is a sectional view of a second preferred embodiment of the lamination-type resistance element.

A lamination-type resistance element 31 preferably includes a laminated sinter 33 in which a plurality of NTC thermistor layers 32 is laminated and integrally sintered. First internal electrodes 34*a* and second internal electrodes 34*b* are included in the laminated sinter 33. Furthermore, an internal electrode 36 is arranged so as to face the first internal electrodes 34*a* and the second internal electrodes 34*b* through a thermistor layer 32. External electrodes 39 and 40 are provided on the external surface of the laminated sinter 33, specifically, at both end portions.

One end portion of the first internal electrode 34*a* as a divided internal electrode and one end portion of the second internal electrode 34*b* as a divided internal electrode are arranged to face each other on the same plane with a gap 35 therebetween inside the laminated sinter 33. The other end portion of the first internal electrode 34*a* is electrically connected to the external electrode 39 and the other end portion of the second internal electrode 34*b* is electrically connected to the external electrode 40.

The internal electrode 36, in which both end portions are not extended to the external surface of the laminated sinter 33, is a no-connection-type internal electrode not electrically connected to the external electrodes 39 and 40. The structure having the first internal electrodes 34*a*, the second internal electrodes 34*b*, and the no-connection-type internal electrode 36 corresponds to first internal electrode group C of the present preferred embodiment.

Moreover, in the first internal electrode group C, the first internal electrodes 34*a* and second internal electrodes 34*b* and the no-connection-type internal electrode 36 lie on top of one another through a thermistor layer. That is, a resistance unit having the internal electrodes 34*a* and 34*b* and the no-connection-type internal electrode 36 is produced. One end of the resistance unit is connected to the first external electrode 39 and the other end is connected to the second external electrode 40.

Furthermore, also in the present preferred embodiment, it is sufficient to have at least two internal electrodes disposed so as to lie on top of one another with a thermistor layer therebetween, that is, it is sufficient that the number of ceramic resistance layers sandwiched by internal electrodes is one or more and the number is not restricted in particular.

The lamination-type thermistor 31 further includes the following structure. That is, a second internal electrode group D is provided inside the laminated sinter 33 so as to be close to the first internal electrode group C.

The second internal electrode group D includes the following structure. Third internal electrodes 37*a* and fourth internal electrodes 37*b* are included inside the laminated sinter 33 in which a plurality of thermistor layers 32 are laminated and integrally sintered. One end portion of a third internal electrode 37*a* and one end portion of a fourth internal electrode 37*b* face each other on the same plane with a gap 38 therebetween inside the laminated sinter 33. The other end portion of the third electrode 37*a* is electrically connected to the external electrode 39 and the other end portion of the fourth electrode 37*b* is electrically connected to the external electrode 40.

The gaps 38 of the second internal electrode group D are arranged at the same location along the lamination direction of the plurality of thermistor layers 32 inside the laminated sinter 33. The gaps 38 shown in FIG. 2 are arranged so as to be substantially at the same distance from both end portions of the laminated sinter 33, that is, to be located substantially in the middle. Furthermore, the gaps 38 are preferably arranged at the same location as the gaps 35 of the first internal electrode group C when seen from the lamination direction of the thermistor layers 32, more specifically, at the same location in the direction of the connection of both end portions of the laminated sinter 33, but the gaps 38 may be arranged at different locations. Furthermore, in the second internal electrode group D shown in FIG. 2, although the third internal electrodes 37*a* and the fourth internal electrodes 37*b* are provided in three layers, the number of layers may be designed according to the target resistance value. Furthermore, in FIG. 2, although the thickness of the NTC thermistor layers 32*a* existing between the first internal electrode group C and the second internal electrode group D is preferably larger than the thickness of the other NTC thermistor layers 32, the thickness may be made the same.

In the lamination-type resistance element according to the second preferred embodiment, the resistance value is determined in the following way. That is, in the first internal electrode group C, the resistance value is determined by the size of the gap 35 between the first internal electrode 34*a* and the second internal electrode 34*b*, the overlapping area between the first internal electrode 34*a* and the no-connection-type internal electrode 36 and the space between the both, and the overlapping area between the second internal electrode 34*b* and the no-connection-type electrode 36 and the space between the both. Furthermore, in the second internal electrode group D, the resistance value is determined by the size of the gap 38 between the third internal electrode 37*a* and the fourth internal electrode 37*b*. Accordingly, the resistance value of the lamination-type resistance element becomes a composite resistance value of the resistance values of the first internal electrode group C and the second internal electrode group D. In the second internal electrode group D, although the resistance value is determined by the size of the gap 38, a plurality of gaps 38 is at neighboring locations along the lamination direction of the thermistor layers and arranged at the same location, and the resistance value determined by the size of the gap 38 is small. Accordingly, fine adjustment of the resistance value of the whole of the lamination-type resistance element becomes possible by means of the second internal electrode group D.

Figure 3:
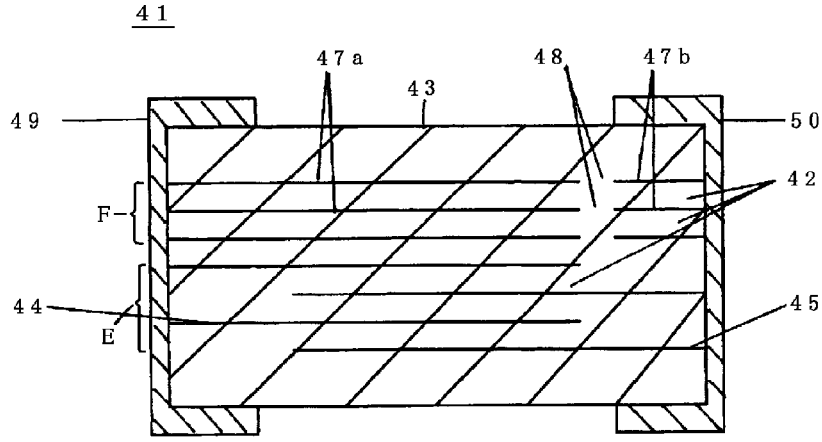
FIG. 3 is a sectional view showing a third preferred embodiment of a lamination-type resistance element of the present invention.

FIG. 3 is a sectional view of a third preferred embodiment of the lamination-type resistance element.

In a lamination-type resistance element 41 shown in FIG. 3, first internal electrodes 44 and second internal electrodes 45 are provided inside a laminated sinter 43 in which a plurality of NTC thermistor layers 42 are laminated and integrally sintered. External electrodes 49 and 50 are provided on the outer surface, specifically, in both end portions of the laminated sinter 43.

The first internal electrode 44 and the second internal electrode 45 are arranged so that one end portion of each electrode may extend to one end portion of the laminated sinter 43. The other end portion of the first internal electrode 44 is electrically connected to the external electrode 49 and the other end portion of the second internal electrode 44 is electrically connected to the external electrode 50. The structure of the first internal electrodes 44 and 45 corresponds to the first internal electrode group E of the present preferred embodiment.

In the present preferred embodiment, in the first internal electrode group E, a plurality of internal electrodes 44 and 45 are disposed so as to lie on top of one another through a thermistor layer as a ceramic resistance layer. A resistance unit having the plurality of internal electrodes 44 and 45 is produced, and one end of the resistance unit is connected to the external electrode 49 and the other end is connected to the external electrode 50.

Figure 4:
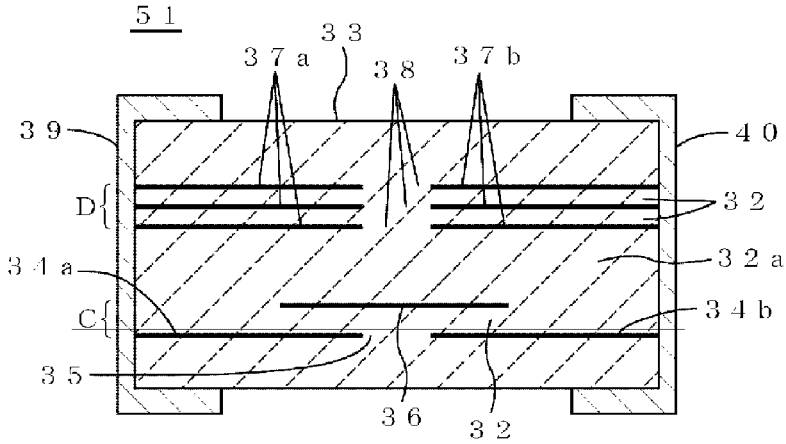
FIG. 4 is a front sectional view showing a modified example of a lamination-type resistance element for describing the process for making fine adjustment of the resistance value by using a lamination-type resistance element of the present invention.

Moreover, the number of laminations of the internal electrodes lying on top of one another with a thermistor layer therebetween, which defines the above resistance unit, is not limited to four as shown in FIG. 4. That is, it is sufficient that at least two internal electrodes are disposed so as to lie on top of one another with a thermistor layer therebetween. That is, the number of ceramic resistance layers, which are sandwiched between internal electrodes, for taking out the resistance value, may be one or more.

The lamination-type thermistor 41 further includes the following structure. That is, a second internal electrode group F is provided next to the first internal electrode group E inside the laminated sinter 43.

The second internal electrode group F has the following structure. Third internal electrodes 47*a* and fourth internal electrodes 47*b* are provided inside the laminated sinter 43 in which the plurality of thermistor layers 42 are laminated and integrally sintered. The third internal electrodes 47*a* and the fourth internal electrodes 47*b* are arranged in such a way that one end portion of an electrode 47*a* and one end portion of an electrode 47*b* face each other on the same plane with a gap 48 therebetween inside the laminated sinter 43. The other end portion of the third internal electrode 47*a* is electrically connected to the external electrode 49 and the other end portion of the fourth internal electrode 47*b* is electrically connected to the external electrode 50.

A plurality of gaps 48 of the second internal electrode group F is provided inside the laminated sinter 43 in such a way that the gaps 48 are next to each other along the lamination direction of the plurality of thermistor layers 42 and at the same location when seen from the lamination direction. The gaps 48 shown in FIG. 3 are arranged so as to be close to the external electrode 50. Moreover, in the second internal electrode group F shown in FIG. 3, although the third internal electrode 47*a* and the fourth internal electrode 47*b* are provided in three layers, it is sufficient that they are provided so as to have at least two layers.

In the lamination-type resistance element according to the third preferred embodiment, the resistance value is determined in the following way. That is, in the first internal electrode group E, the resistance value is determined by the overlapping area of the first internal electrode 44 and the second internal electrode 45 and the space between the internal electrodes 44 and 45. Moreover, in the second internal electrode group F, the resistance value is determined by the gap 48 between the third internal electrode 47*a* and the fourth internal electrode 47*b*. Accordingly, the resistance value of the lamination-type resistance element becomes a composite resistance value of the first internal electrode group E and the second internal electrode group F. In the second internal electrode group F, the resistance value is determined by the size of the gaps 48. The gaps are positioned so as to be next to each other in the lamination direction of the thermistor layers 42 and to be at the same location when seen from the lamination direction. The resistance value given by the size of the plurality of gaps 48 is small. Accordingly, it becomes possible to make fine adjustment of the whole resistance value of the lamination-type resistance element by means of the second internal electrode group F.

Next, it is more specifically described that, when the lamination-type resistance element of the present preferred embodiment is used, it is possible to make fine adjustment of the resistance value by increasing or decreasing the number of laminated layers of the second internal electrode group.

FIG. 4 is a front sectional view of a lamination-type thermistor 51 according to a modified example of the resistance thermistor 31 of the preferred embodiment shown in FIG. 2. The lamination-type thermistor 51 is the same as the lamination-type thermistor 31 except that the first internal electrode 34*a* and the second internal electrode 34*b* in the uppermost layer shown in FIG. 2 are not provided. Accordingly, the same reference numerals are given to the same elements, and the description thereof is omitted.

Figure 5:
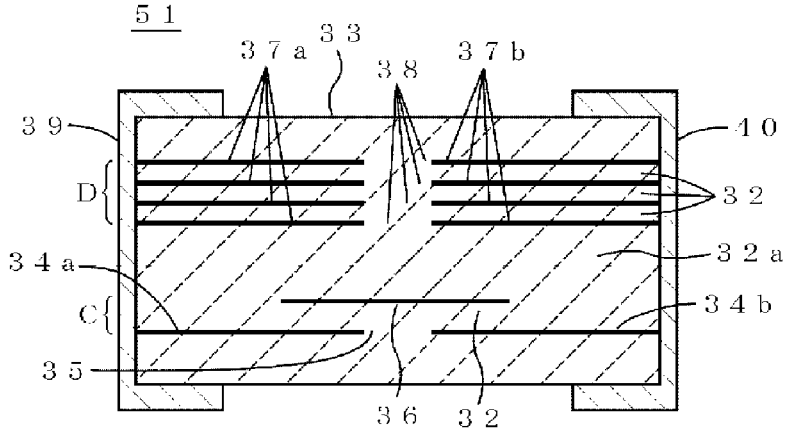
FIG. 5 is a front sectional view of a lamination-type resistance element obtained by increasing the number of laminations of the second group of internal electrodes of the lamination-type resistance element shown in FIG. 4.

It is now assumed that a lamination-type thermistor 51 having a resistance value of 47,000Ω in design as shown in FIG. 4 is manufactured by way of experiment using a specific thermistor material, for example. However, practically there are variations in the thermistor material to be used and the resistance value of the obtained lamination-type thermistor 51 may vary. For example, when the resistivity of the thermistor material is high, the resistance value becomes higher than 47,000Ω. For example, when the resistance value is about 47,734Ω, it is sufficient to increase the number of pairs of internal electrodes by one regarding the second internal electrode group as shown in FIG. 5. In this way, the resistance value can be reduced by about 4.0% by increasing the number of pairs of electrodes provided in the third and fourth internal electrodes of the first internal electrode group by one.

Figure 6:
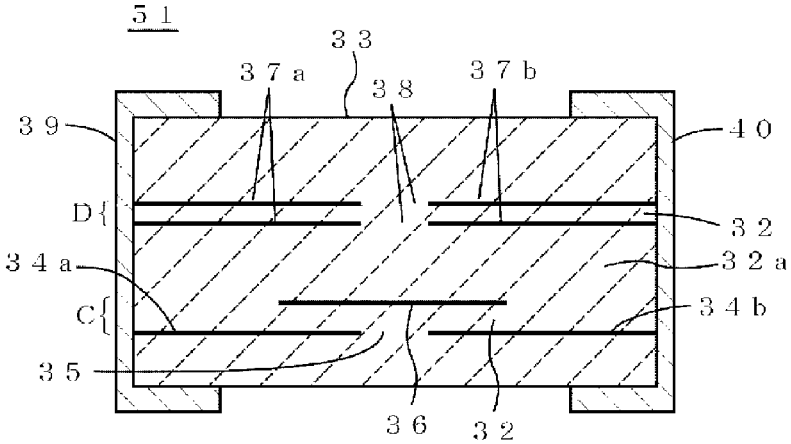
FIG. 6 is a front sectional view of a lamination-type resistance element obtained by decreasing the number of laminations of the second group of internal electrodes of the lamination-type resistance element shown in FIG. 4.
Figure 7:
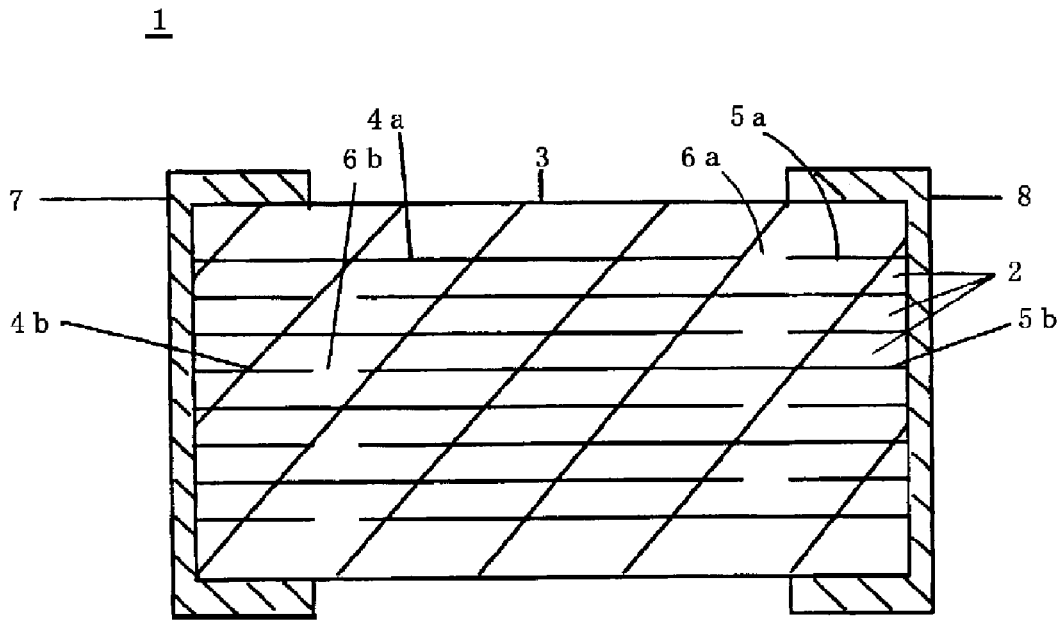
FIG. 7 PRIOR ART
FIG. 7 is a sectional view showing a first example of a related lamination-type resistance element.
Figure 8:
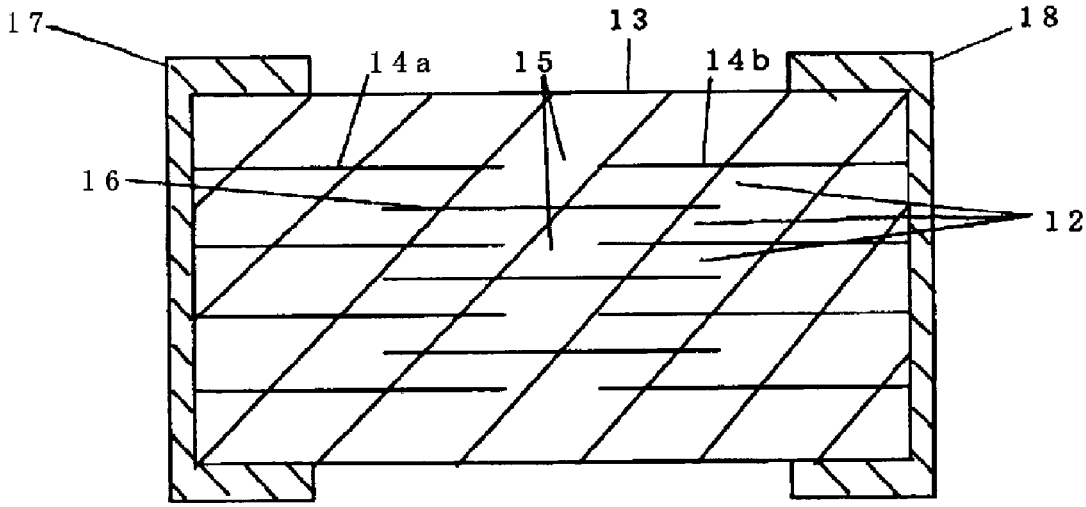
FIG. 8 PRIOR ART
FIG. 8 is a sectional view showing a second example of the related lamination-type resistance element.

Furthermore, when the resistivity of the thermistor material to be used becomes smaller, the lamination-type thermistor 51 having a resistance value lower than the target resistance value can be obtained. That is, when the lamination-type thermistor 51 shown in FIG. 4 is manufactured by way of experiment and the resistance value becomes about 45,825Ω, it is sufficient to reduce the number of pairs of electrodes provided in the third and fourth internal electrodes 37*a* and 37*b* in the first internal electrode group by one to result in two as shown in FIG. 6. In this case, it is possible to increase the resistance value by about 2.5% and, as a result, it is possible to achieve the target resistance value of 47,000Ω.

As described above, in the lamination-type resistance element of the present preferred embodiments, it is understood that fine adjustment of the resistance value can be performed by increasing or decreasing the number of pairs of electrodes provided in the third and fourth internal electrodes in the first internal electrode group. When the number of pairs of electrodes increases, very fine adjustment of the resistance value can be performed, such as a change in the resistance value of about 0.5%, for example. Accordingly, it is understood that very fine adjustment of the resistance value over a wide range can be performed by changing the number of laminations of electrodes.

In each lamination-type resistance element in the above-described preferred embodiments, an example of an NTC thermistor is shown, but the lamination-type resistance element can be applied to PTC thermistors.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A lamination-type resistance element comprising:

a laminated sinter having a plurality of ceramic resistance layers and a plurality of internal electrodes laminated therein; and a first external electrode and a second external electrode provided on the outer surface of the laminated sinter; wherein the plurality of internal electrodes includes a plurality of internal electrodes of a first group and a plurality of internal electrodes of a second group;

each of the plurality of internal electrodes of the first group includes a resistance unit in which at least two internal electrodes are disposed so as to face each other through one of the ceramic resistance layers, a first end of the resistance unit is electrically connected to the first external electrode, and a second end is electrically connected to the second external electrode;

each of the internal electrodes of the second group includes a plurality of pairs of internal electrodes in which a first end of one electrode faces a first end of the other electrode with a gap therebetween on the same plane inside the laminated sinter, one internal electrode in each pair is electrically connected to the first external electrode, and the other is electrically connected to the second external electrode;

the gaps between the first ends of each of the plurality of pairs of internal electrodes of the second group overlap with each other in a lamination direction of the laminated sinter;

each of the internal electrodes of the first group includes a first divided internal electrode electrically connected to the first external electrode and a second divided internal electrode electrically connected to the second external electrode, and a first end of the first divided internal electrode and a first end of the second divided internal electrode face each other with a gap therebetween on the same plane; and a plurality of pairs of first and second divided internal electrodes is laminated and the gaps in neighboring pairs of electrodes in the lamination direction are arranged at different locations when seen from one side in the lamination direction.

2. The lamination-type resistance element as claimed in claim 1, wherein the gap between the first end of the first divided internal electrode and the first end of the second divided internal electrode that is arranged closest to the second group overlaps, in the lamination direction of the laminated sinter, with the gap between the first ends of the pair of internal electrodes of the second group that is arranged closest to the first group.

3. The lamination-type resistance element as claimed in claim 1, wherein each of the internal electrodes of the first group each includes a first internal electrode electrically connected to the first external electrode and a second internal electrode electrically connected to the second external electrode, and the first and second internal electrodes are disposed so as to lie on top of one another with a ceramic layer disposed therebetween.

4. A lamination-type resistance element comprising:

a laminated sinter having a plurality of ceramic resistance layers and a plurality of internal electrodes laminated therein; and a first external electrode and a second external electrode provided on the outer surface of the laminated sinter; wherein the internal electrodes include internal electrodes of a first group and internal electrodes of a second group;

each of the internal electrodes of the first group includes a first internal electrode and a second internal electrode in which a first end of the first internal electrode is arranged so as to face a first end of the second internal electrode with a gap therebetween on the same plane inside the laminated sinter and second ends of the first and second internal electrodes are connected to the first external electrode and the second external electrode, respectively, and neighboring gaps between the first and second internal electrodes in a lamination direction of the laminated sinter are arranged at different locations when seen from the lamination direction of the laminated sinter;

each of the internal electrodes of the second group includes a third internal electrode and a fourth internal electrode in which a first end of the third internal electrode faces a first end of the fourth internal electrode other with a gap therebetween on the same plane inside the laminated sinter, and second ends are connected to the first external electrode and the second external electrode, respectively, and the gaps between the third internal electrodes and fourth internal electrodes are at the same location along the lamination direction of the laminated sinter and the gap between the first end of the first internal electrode and the first end of the second internal electrode that is arranged closest to the second group overlaps, in the lamination direction of the laminated sinter, with the gap between the first ends of the third internal electrode and the fourth internal electrode that is arranged closest to the first group.

5. A lamination-type resistance element comprising:

a laminated sinter having a plurality of ceramic resistance layers and a plurality of internal electrodes laminated therein; and a first external electrode and a second external electrode provided on the outer surface of the laminated sinter; wherein the internal electrodes include internal electrodes of a first group and internal electrodes of a second group;

each of the internal electrodes of the first group includes a first internal electrode and a second internal electrode in which a first end of the first internal electrode is arranged so as to face a first end of the second internal electrode with a gap therebetween on the same plane inside the laminated sinter, and second ends are connected to the first external electrode and the second external electrode, respectively, and a no-connection-type internal electrode which is arranged so as to lie on top of the first internal electrode and the second internal electrode through the ceramic resistance layer in a lamination direction of the laminated sinter and which is not connected to the first and second external electrodes;

each of the internal electrodes of the second group includes a third internal electrode and a fourth internal electrode in which a first end of the third internal electrode faces a first end of the fourth internal electrode with a gap therebetween on the same plane inside the laminated sinter, and second ends are connected to the first external electrode and the second external electrode, respectively, and the gaps between the third internal electrodes and fourth internal electrodes are at the same location along the lamination direction of the laminated sinter; and the gap between the first end of the first internal electrode and the first end of the second internal electrode that is arranged closest to the second group overlaps, in the lamination direction of the laminated sinter, with the between the first ends of the third internal electrode and the fourth internal electrode that is arranged closest to the first group.

6. A lamination-type resistance element comprising:

a laminated sinter having a plurality of ceramic resistance layers and a plurality of internal electrodes laminated therein; and a first external electrode and a second external electrode provided on the outer surface of the laminated sinter; wherein the internal electrodes include internal electrodes of a first group and internal electrodes of a second group;

each of the internal electrodes of the first group includes a first internal electrode connected to the first external electrode and a second internal electrode connected to the second external electrode which face each other through the ceramic resistance layer;

each of the internal electrodes of the second group includes a third internal electrode and a fourth internal electrode in which a first end of third internal electrode faces a first end of the fourth internal electrode with a gap therebetween on the same plane inside the laminated sinter, and second ends are connected to the first external electrode and the second external electrode, respectively, and the gaps between the third internal electrodes and fourth internal electrodes are at the same location along a lamination direction of the laminated sinter; and an end of the internal electrode of the first group that is arranged closest to the second group overlaps, in the lamination direction of the laminated sinter, with the first end of one of the third and fourth internal electrodes that is arranged closest to the first group.

7. The lamination-type resistance element as claimed in claim 6, wherein the gaps between the first ends of each of the plurality of pairs of internal electrodes of the second group overlap with each other in the lamination direction in the laminated sinter.

8. A lamination-type resistance element comprising:

a laminated sinter having a plurality of ceramic resistance layers and a plurality of internal electrodes laminated therein; and a first external electrode and a second external electrode provided on the outer surface of the laminated sinter; wherein the plurality of internal electrodes includes a plurality of internal electrodes of a first group and a plurality of internal electrodes of a second group;

each of the plurality of internal electrodes of the first group includes a resistance unit in which at least two internal electrodes are disposed so as to face each other through one of the ceramic resistance layers, a first end of the resistance unit is electrically connected to the first external electrode, and a second end is electrically connected to the second external electrode;

each of the internal electrodes of the second group includes a plurality of pairs of internal electrodes in which a first end of one electrode faces a first end of the other electrode with a gap therebetween on the same plane inside the laminated sinter, one internal electrode in each pair is electrically connected to the first external electrode, and the other is electrically connected to the second external electrode;

the gaps between the first ends of each of the plurality of pairs of internal electrodes of the second group overlap with each other in a lamination direction of the laminated sinter;

each of the internal electrodes of the first group includes a first divided internal electrode electrically connected to the first external electrode and a second divided internal electrode electrically connected to the second external electrode, and a first end of the first divided internal electrode and a first end of the second divided internal electrode face each other with a gap therebetween on the same plane; and the first group includes a no-connection-type internal electrode disposed on top of the first and second divided internal electrodes through a ceramic resistance layer.

9. The lamination-type resistance element as claimed in claim 8, wherein the gap between the first end of the first divided internal electrode and the first end of the second divided internal electrode that is arranged closest to the second group overlaps, in the lamination direction of the laminated sinter, with the gap between the first ends of the pair of internal electrodes of the second group that is arranged closest to the first group.

10. The lamination-type resistence element as claimed in claim 8, wherein each of the internal electrodes of the first group each includes a first internal electrode electrically connected to the first external electrode and a second internal electrode electrically connected to the second external electrdoe, and the first and second internal electrodes are disposed so as to lie on top of one another with a ceramic layer disposed therebetween.

* * * * *